United States Patent [19]

Murray

[11] 4,429,827

[45] Feb. 7, 1984

[54] DOCUMENT MAILER AND POSTAL SYSTEM

[76] Inventor: Myles N. Murray, 15 Skyline Dr., Chagrin Falls, Ohio

[21] Appl. No.: 293,296

[22] Filed: Aug. 17, 1981

[51] Int. Cl.[3] ..... B65D 27/00

[52] U.S. Cl. ..... 229/68 R; 229/70; 229/73; 229/74; 282/25

[58] Field of Search ..... 229/70, 72, 73, 92.8, 229/68, 79, 71, 74; 282/11.5, 25; 281/18

[56] References Cited

U.S. PATENT DOCUMENTS

| | | | |
|---|---|---|---|
| 479,555 | 7/1892 | Carroll | 229/70 |
| 1,668,985 | 5/1928 | Simpson | 229/72 |
| 3,365,117 | 1/1968 | Powell, Jr. | 229/71 |
| 3,937,492 | 2/1976 | Biron | 229/73 |
| 3,952,942 | 4/1976 | O'Leary et al. | 229/73 |
| 4,055,294 | 10/1977 | Traise | 229/73 |

FOREIGN PATENT DOCUMENTS

| | | | |
|---|---|---|---|
| 645304 | 10/1950 | United Kingdom | 229/68 |

*Primary Examiner*—George E. Lowrance
*Assistant Examiner*—Jimmy G. Foster
*Attorney, Agent, or Firm*—Maky, Renner, Otto & Boisselle

[57] ABSTRACT

A mailer and postal system are characterized by a document enclosure including a window through which a return receipt is detachably secured to the document. When delivered, the return receipt is endorsed by the recipient, detached from the document and returned to the sender as proof of receipt of the document as well as the mailer. The postal system also provides for proof of receipt and delivery by the receiving and delivering Post Offices by employing identifying coded perforations in a certified mail receipt affixed to the document and in the return receipt, respectively.

10 Claims, 6 Drawing Figures

DOCUMENT MAILER AND POSTAL SYSTEM

This invention relates generally, as indicated, to a document mailer and postal system.

BACKGROUND OF THE INVENTION

Conventional practice relating to return receipt, registered, insured and certified mail has been to affix a return receipt to the envelope or other mailer containing the document or other item to be mailed. When the mailer is delivered by the Postal Service, the recipient acknowledges receipt of the mailer by endorsing the return receipt. The return receipt is then detached from the mailer and returned by the Postal Service to the sender as proof of receipt of the mailer. The customary return receipt used for this purpose consists of a post card which is detachably secured at its ends to gummed tabs which provide for the requisite attachment to the mailer.

For certified mail, a receipt additionally is affixed to the mailer. The customary receipt for certified mail includes a gummed end portion which contains identifying indicia and a removable portion which contains the same identifying indicia. When the mailer is deposited with the receiving Post Office for mailing, the removable portion is appropriately marked as received by the receiving Post Office, removed from the gummed end portion which remains affixed to the mailer, and returned to the sender as proof of receipt of the thusly identified mailer by the receiving Post Office.

As recognized by applicant herein, such conventional practice does not provide any guarantee or proof that the document in the mailer was received by the recipient who endorsed the return receipt. The receiver can deny having received the document such as by claiming that the mailer was empty or contained a different document than that actually mailed by the sender, and the sender has no way of proving or determining the veracity of such assertions.

SUMMARY OF THE INVENTION

The mailer and postal system according to the present invention provides assurance and proof that the recipient of the mailer received the contents thereof. Briefly, the mailer includes an enclosure in which a document or other item is to be mailed, which enclosure has an opening or window therein for exposing a portion of the item contained in the enclosure. The mailer further includes a return receipt, means detachably securing the return receipt to the enclosure, and means for detachably securing the return receipt to the item contained within the enclosure at the window in the enclosure. Such means preferably are in the form of gummed tabs from which the return receipt can be detached, one tab being affixed to the enclosure and the other affixable to the item contained in the enclosure at the window in the enclosure.

In use, the item to be mailed is inserted in the enclosure with a portion thereof exposed by the window whereupon the affixable tab is secured directly to the item at the window. Upon delivery of the mailer by the Postal Service, the recipient endorses the return receipt to acknowledge receipt of the mailed item as well as the mailer. The endorsed return receipt is then detached from the mailer and returned to the sender by the Postal Service as proof of receipt of the mailed item and the mailer by the recipient.

Further in accordance with the invention, a receipt for certified mail or the like also may be affixed directly to the item contained in the mailer at the portion thereof exposed by the window in the mailer. The receipt for certified mail includes a first part affixed securely to the item at the window and a removable second part, both parts containing the same identifying indicia such as a certification number. The receipt for certified mail further is folded so that both parts thereof are coextensive in the area of attachment to the item in the mailer. When deposited at the receiving Post Office, a plurality of coded perforations identifying the receiving Post Office are punched in the coextending portions of the first and second parts as well as through the item being mailed. The second part may then be removed and returned to the sender as proof of receipt by the receiving Post Office. Upon delivery of the mailer by the delivering Post Office to the recipient thereof, the return receipt is endorsed by the recipient and detached from the mailer. Thereafter, the endorsed return receipt is punched with coded perforations identifying the delivering Post Office, and is returned to the sender with the coded perforations in the return receipt providing further proof that the mailer and document were delivered to the recipient.

To the accomplishment of the foregoing and related ends, the invention, then, comprises the features hereinafter fully described and particularly pointed out in the claims, the following description and the annexed drawings setting forth in detail certain illustrative embodiments of the invention, these being indicative, however, of but a few of the various ways in which the principles of the invention may be employed.

DETAILED DESCRIPTION

Figure 1:
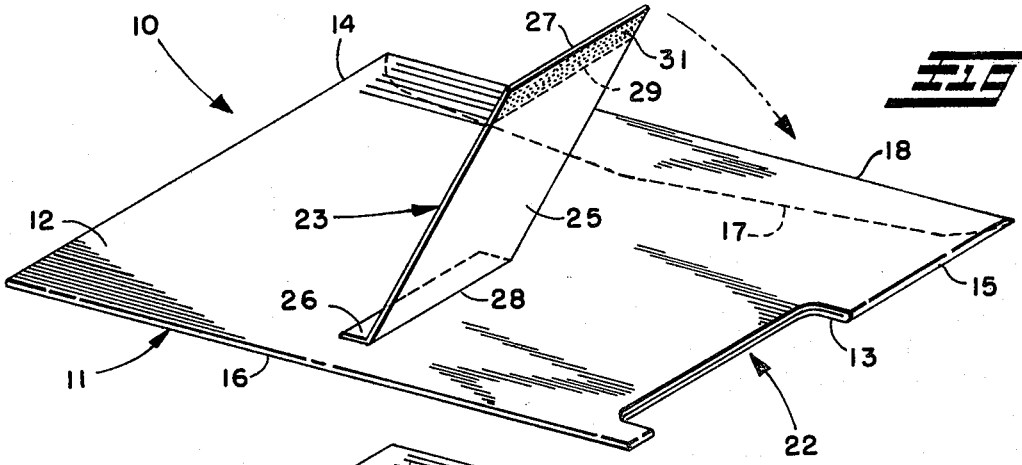
FIG. 1 is a perspective view of a mailer according to the invention.

Referring now in detail to the drawings and initially to FIG. 1, a mailer according to the invention is designated generally by reference numeral 10 and includes an envelope or enclosure 11 for the document or other item to be mailed. In the illustrated embodiment, the enclosure is similar to a conventional envelope sized to accommodate letter size documents; but it should be understood that the enclosure may be of different sizes and take other forms as well. It is contemplated that a number of different sizes of mailers will be provided for general business usage with the enclosures thereof being in the form of conventionally sized envelopes.

The enclosure 11 includes a front panel 12 and a back panel 13 which are joined together by side edge creases 14 and 15 and bottom edge crease 16. The top edges of the panels are not joined so that an opening is formed through which a document may be inserted into the enclosure. A flap 17 provided at the top edge 18 of the front panel may be folded over and affixed by gummed adhesive thereon to the back panel to close the opening and secure the document within the enclosure.

At the lower right hand corner of the enclosure 11 as seen in FIG. 1, an opening or window 22 and a return receipt card 23 are provided. The window 22 may be in the form of a cut out located at the side edge crease 15 or for that matter at any of the other edge creases. Although the window preferably is located at an edge of the closure, such alternatively may be located in the panels 12 and 13 interiorly of the edge creases.

The return receipt card 23 includes a return receipt 25 in the form of a post card and gummed end portions or tabs 26 and 27. The end portion 26 is secured as indicated to the front panel 12 of the enclosure 11 such that the other end portion 27 will overlap the window 22 when the return receipt card is caused to lay against the front panel 12. Both end portions 26 and 27 are separated from the return receipt 25 by respective rows or lines of perforations indicated at 28 and 29. Accordingly, the return receipt can be easily detached from the end portions along such perforation lines.

In use, the return receipt card 23 of the mailer 11 can be folded along the perforation line 28 to expose the back side thereof so that the sender may place thereon an appropriate return address. In addition, postage may be affixed to such back side or printed matter may already have been applied thereto evidencing prepaid postage. In addition, instructions setting forth how to use the mailer may be printed on such back side. The mailer also may be addressed to the intended recipient at this time in the customary manner.

Figure 2:
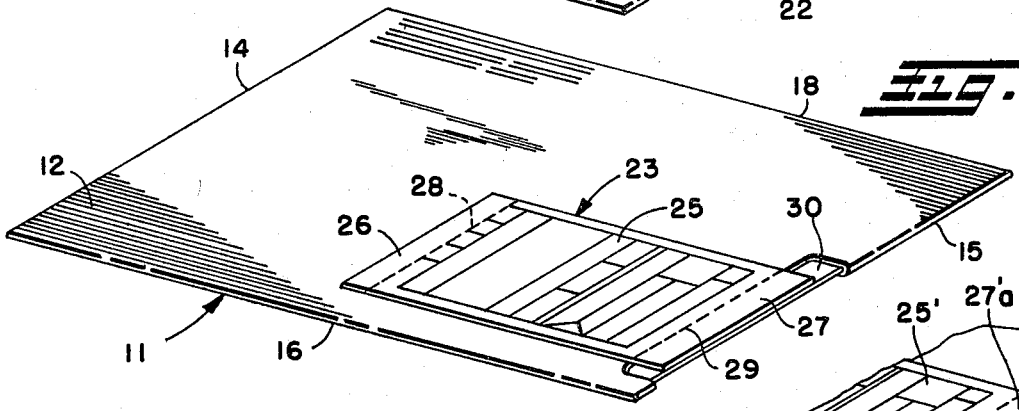
FIG. 2 is a perspective view of the mailer of FIG. 1 as used in accordance with the present invention.

As seen in FIG. 2, the document 30 or other item to be mailed may be inserted into the enclosure 11 and positioned therein so that a part thereof is exposed by the window 22. Once positioned in this manner, the end portion 27 of the return receipt card 23 may be affixed directly to the document by means of the gummed adhesive indicated at 31 in FIG. 1. It will be appreciated that other means of affixing the end portion 27 to the document may be used as desired.

Figure 2A:
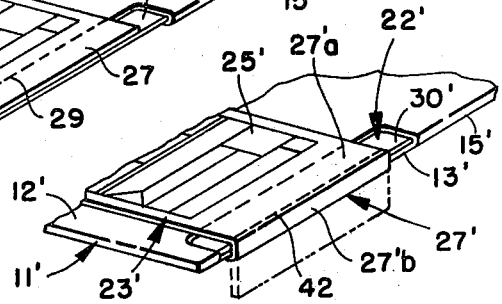
FIG. 2A is a fragmentary perspective view showing another form of mailer according to the invention.

It also should be appreciated that the end portion 27' may have a greater length than that shown so that it may be folded about the exposed edge of the document 30' and affixed to the back panel 13' of the enclosure as seen in FIG. 2A, wherein primed reference numerals designate elements corresponding generally to those identified above by the same unprimed reference numerals. This essentially closes the window for greater security in mailing. That is, such arrangement maintains the front and back panels closely adjacent the document at the window to prevent viewing of all but a small portion of the document. In this form of mailer, the window 22' preferably is formed only in the front panel 12' at the edge crease 15' whereas the back panel 13' extends up to such edge as indicated. In addition, the end portion 27' preferably is divided by a line of perforations 42 into two parts **27'*a* and 27'*b*** which may be fixed respectively to the document and back panel. Such line of perforations provides for easy separation of the two parts to permit removal of the document from the enclosure by the recipient.

Figure 5:
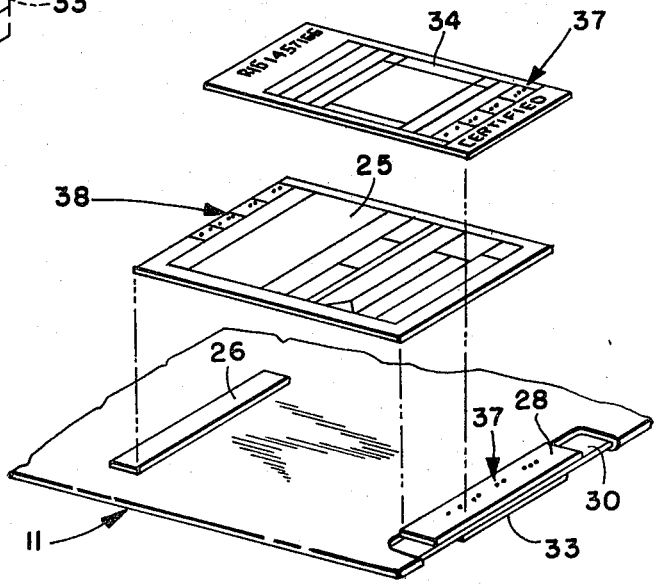
FIG. 5 is an exploded perspective view of the mailer of FIG. 3 showing the removable part of the receipt for certified mail and return receipt detached from the mailer.

The addressed mailer 10, with the return receipt card 23 secured to the document 30 as indicated, may then be deposited with the Postal Service for delivery. Upon delivery the recipient endorses the front side of the return receipt 25 which is provided with appropriate printed matter acknowledging receipt of the document and mailer upon endorsement by the recipient. The return receipt is then detached by separating same from the end portions 26 and 27 along the perforation lines 28 and 29 as illustrated in FIG. 5 and returned to the sender as proof of receipt of the document 30 as well as the mailer.

Although the aforedescribed mailer 11 preferably is first assembled as indicated and then disseminated for use, the invention also embodies assemblage of the mailer by the sender utilizing conventional mailing materials. In such case, a conventional envelope or other enclosure may be provided with a cut out or window to allow affixation of one end tab of a return receipt card supplied by the Postal Service to the document. The other end tab of the return receipt card may be secured to the envelope. It also should be appreciated that the end tab secured to the document contained within the envelope also may be secured to the envelope adjacent the window.

Figure 3:
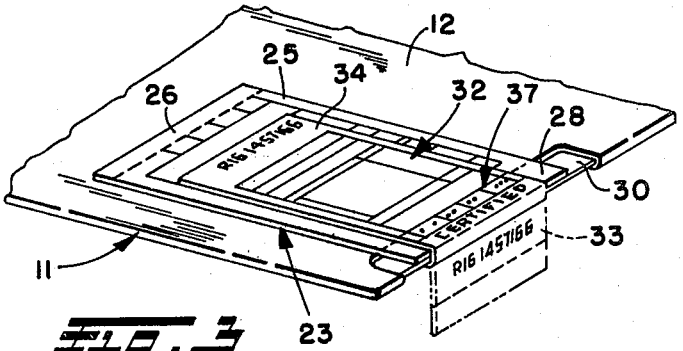
FIG. 3 is a fragmentary perspective view of the mailer of FIG. 1 as employed with a receipt for certified mail.
Figure 4:
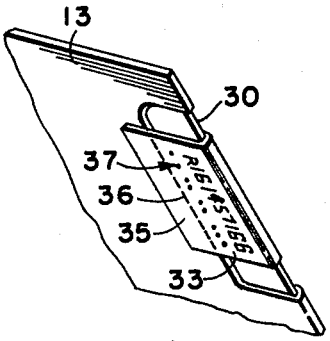
FIG. 4 is a fragmentary perspective view showing the back side of the mailer of FIG. 3.

Referring now to FIGS. 3 and 4, it will be seen that the mailer 11 may be used in conjunction with a receipt for certified mail 32. Such receipt 32 includes a gummed first part or tab 33 which may be affixed to the document 30 as indicated and a removable second part 34, both parts containing identical identifying indicia. Such receipt further may include a gummed tab extension 35 which may be separated from the tab 33 along a row of perforations 36. Such tab extension may be affixed to the back panel 13 of the enclosure whereby the window 22 is essentially closed for greater security in mailing. That is, the tab and tab extension maintain the back panel closely adjacent the document at the window to prevent viewing of all but a small portion of the document. Of course, the entire underside of the document may be hidden from view by employing a tab and tab extension that have widths greater than that of the window. The row of perforations 36 provide for easy separation of the tab from the tab extension to permit removal of the document from the enclosure with the tab containing the identifying inditia remaining affixed to the document. Accordingly, the document is positively identified even after removal from the enclosure.

When affixed to the document 30, the receipt 32 is folded about the edge of the document so that the tab 33 and removable part 34 are coextensive or overlap in the area of attachment of such tab to the document. When deposited at the receiving Post Office, a plurality of coded perforations indicated at 37 are formed, such as by punching, in the coextending portions of the tab and removable part to identify the receiving Post Office and to indicate receipt by such receiving Post Office. The coded perforations for example may designate the zip code of the receiving Post Office in binary code. Other identifying perforations also may be provided to identify positively the document and its correlation to the receipt for certified mail, i.e., a different set of ordered or coded perforations for each document. The removable part 34 thereafter is removed as illustrated in FIG. 5 and returned to the sender as proof of receipt by the receiving Post Office.

Upon delivery of the mailer 11 to the recipient thereof, the return receipt 25 is endorsed by the recipient, detached and returned to the delivering Post Office where it is provided with coded perforations as at 38 which identify the delivering Post Office and indicate delivery of the document and mailed by such delivering Post Office. Accordingly, the coded perforations 38 in the return receipt provide further proof that the mailer and document were delivered to the recipient. In FIG. 5, the detachment and coding of the return receipt is illustrated.

Although the invention has been shown and described with respect to preferred embodiments, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A mailer in combination with a document, comprising an enclosure in which the document is to be mailed, said enclosure having a window for exposing a part of the document contained in said enclosure, and return receipt means secured to said enclosure for permitting acknowledgement of receipt of the mailer and document by the recipient, said return receipt means including a first portion overlapping said window and affixed to the document at said window, and a second portion constituting a return receipt detachably secured to said first portion and said enclosure whereby said return receipt can be endorsed by the recipient, detached and returned to the sender as acknowledgement of receipt of the document as well as the mailer.

2. The mailer of claim 1 wherein said enclosure is in the form of an envelope having front and back panels joined by edge creases, and said window is located at one of said edge creases.

3. The mailer of claim 1 wherein said return receipt means includes an end tab detachably secured to said return receipt and means affixing said end tab to said enclosure.

4. The mailer of claim 3 wherein said end tab is detachable from said return receipt along a line of perforations.

5. The mailer of claim 1 wherein said first portion is an end tab detachably secured to said return receipt along a line of perforations, and said end tab is affixed by adhesive thereon to the document.

6. The mailer of claim 5 wherein said end tab includes first and second parts detachably secured along a line of perforations, said first and second parts being attached to the document at such window and to the enclosure adjacent said window, respectively.

7. The mailer of claim 6 wherein said enclosure has opposite panels which are joined together at edge creases, said window is adjacent an edge crease, said return receipt means includes a second end tab detachably secured to said return receipt and secured to one of said panels, and said second part is attached to the other of said panels.

8. The combination of claim 1 further comprising a receipt for certified mail, said receipt for certified mail including a first part affixed to said document and a removable second part, said receipt being folded along the edge of said document so that said first and second parts are coextensive in the area of attachment of said first part to said document, and a plurality of coded perforations passing through said first part, second part and document at said area of attachment.

9. The combination of claim 8 wherein said receipt for certified mail includes a third part separable from said first part, said third part being affixed to said enclosure adjacent said window.

10. The combination of claim 8 wherein said coded perforations identify a Post Office.

* * * * *